US006394073B1

(12) United States Patent
Binkele et al.

(10) Patent No.: US 6,394,073 B1
(45) Date of Patent: May 28, 2002

(54) HYDRAULIC VALVE WITH HYDRAULICALLY ASSISTED OPENING AND FUEL INJECTOR USING SAME

(75) Inventors: Benjamin H. Binkele, Marquette Heights; David E. Martin, Normal; Timothy J. Matzke, El Paso; Evan E. Jacobson, Lacon, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/383,877

(22) Filed: Aug. 26, 1999

(51) Int. Cl.[7] ..... F02M 37/04
(52) U.S. Cl. ..... 123/506; 123/467
(58) Field of Search ..... 123/506, 446, 123/458, 467; 251/129.07, 129.16

(56) References Cited

U.S. PATENT DOCUMENTS

| | | | | | |
|---|---|---|---|---|---|
| 2,612,907 | A | | 10/1952 | Harris | |
| 4,021,152 | A | | 5/1977 | Toyoda | |
| 4,522,372 | A | | 6/1985 | Yano et al. | |
| 4,524,947 | A | | 6/1985 | Barnes et al. | |
| 4,702,212 | A | | 10/1987 | Best et al. | |
| 4,932,632 | A | | 6/1990 | Nicol | |
| 4,989,829 | A | * | 2/1991 | Bickel | 251/129.07 |
| 5,082,180 | A | * | 1/1992 | Kubo et al. | 123/129.07 |
| 5,125,807 | A | * | 6/1992 | Kohler et al. | 417/490 |
| 5,150,688 | A | * | 9/1992 | Nothdurft et al. | 123/506 |
| 5,239,968 | A | * | 8/1993 | Rodriguez-Amaya et al. | 123/506 |
| 5,370,095 | A | * | 12/1994 | Yamaguchi et al. | 123/446 |
| 5,413,406 | A | | 5/1995 | Nokubo et al. | |
| 5,450,876 | A | | 9/1995 | Reinicke | |
| 5,636,615 | A | * | 6/1997 | Shorey et al. | 123/506 |
| 5,657,962 | A | | 8/1997 | Neron et al. | |
| 5,732,679 | A | * | 3/1998 | Takahasi et al. | 123/467 |
| 5,746,413 | A | | 5/1998 | Goloff | |
| 5,829,413 | A | * | 11/1998 | Rodriguez-Amaya | 123/506 |
| 5,878,965 | A | * | 3/1999 | Coldren et al. | 251/129.07 |
| 5,971,356 | A | * | 10/1999 | Offenwanger et al. | 251/129.07 |
| 6,027,037 | A | * | 2/2000 | Murakami et al. | 251/129.07 |
| 6,045,120 | A | * | 4/2000 | Tarr et al. | 251/282 |

* cited by examiner

*Primary Examiner*—Carl S. Miller
(74) *Attorney, Agent, or Firm*—Michael B. McNeil

(57) ABSTRACT

A hydraulic valve with hydraulically assisted opening comprises a valve body that defines a fluid passage which includes an upstream segment and a downstream segment. Contained within the valve body is a moveable valve member which includes a hydraulic surface. The hydraulic surface is exposed to fluid pressure within the downstream segment of the fluid passage. When the valve member is in a closed position, the upstream segment of the fluid passage is closed to the downstream segment. The upstream segment is fluidly connected to the downstream segment when the valve member is away from the closed position.

8 Claims, 2 Drawing Sheets

12
13
39
10
14
18
28
36
34
17
45
46
25
48
38
37
41
26
20
30
16
16
35
43
21
22
11
52
23
50
53
64
51
54
60
65
63
62
61
57
55
70

HYDRAULIC VALVE WITH HYDRAULICALLY ASSISTED OPENING AND FUEL INJECTOR USING SAME

TECHNICAL FIELD

This invention relates generally to hydraulic valves, and more particularly to fuel injectors having spill valves with hydraulically assisted opening.

BACKGROUND ART

In many fuel injectors which utilize a spill valve to relieve fluid pressure in the fuel pressurization chamber, a swift opening of the spill valve is desirable. This is beneficial because the longer the spill valve remains in the closed position after an injection event, the longer various components, such as cam and rocker arm assemblies, spend pressurizing fuel as opposed to merely displacing it. In order to prevent excess consumption of engine energy by unnecessarily pressurizing fuel after injection has ended, engineers are always searching for a means to more quickly open the spill valve. A number of fuel injectors currently employ a spill valve to relieve pressure within the fuel pressurization chamber. In these previous fuel injectors, the spill valve must be capable of opening against the action of the hydraulic forces present in the fuel injector which tend to slow this movement to the open position. In these previous injectors, the spill valve spring preload was often low, which is generally not beneficial for spill valve opening. While these foregoing fuel injectors have performed impressively, there is room for improving the speed with which the spill valve opens.

The present invention is directed to overcoming one or more of the problems described above and to exploiting hydraulic forces for a more abrupt opening of the spill valve.

SUMMARY OF THE INVENTION

A hydraulic valve with hydraulically assisted opening comprises a valve body that defines a fluid passage which includes an upstream segment and a downstream segment. Contained within the valve body is a moveable valve member which includes a hydraulic surface. The hydraulic surface is exposed to fluid pressure within the downstream segment of the fluid passage. When the valve member is in a closed position, the upstream segment of the fluid passage is closed to the downstream segment. The upstream segment is fluidly connected to the downstream segment when the valve member is away from the closed position.

BEST MODE FOR CARRYING OUT THE INVENTION

Figure 1:
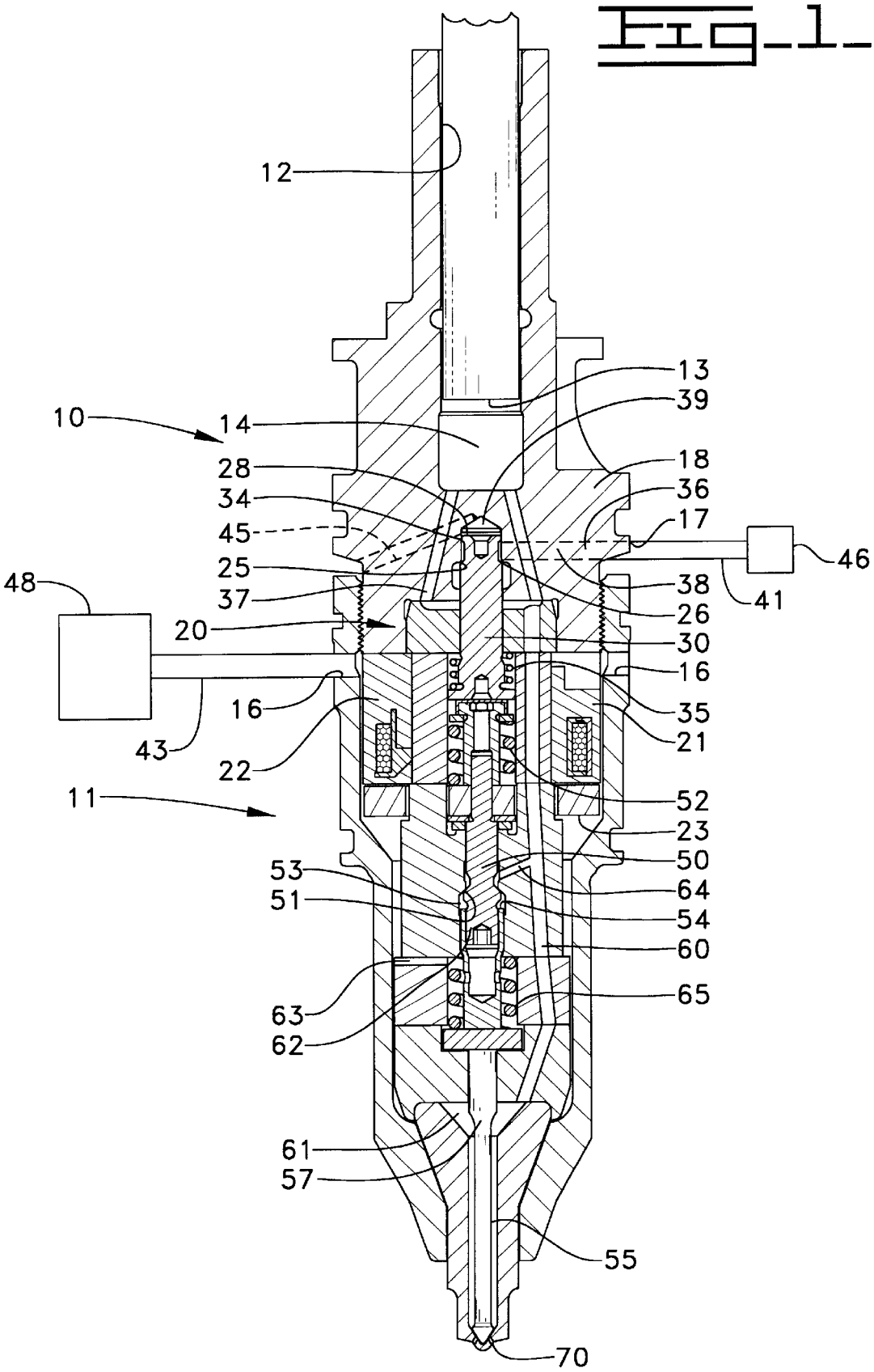
FIG. 1 is a diagrammatic sectioned front view of a fuel injector according to the present invention.
Figure 2:
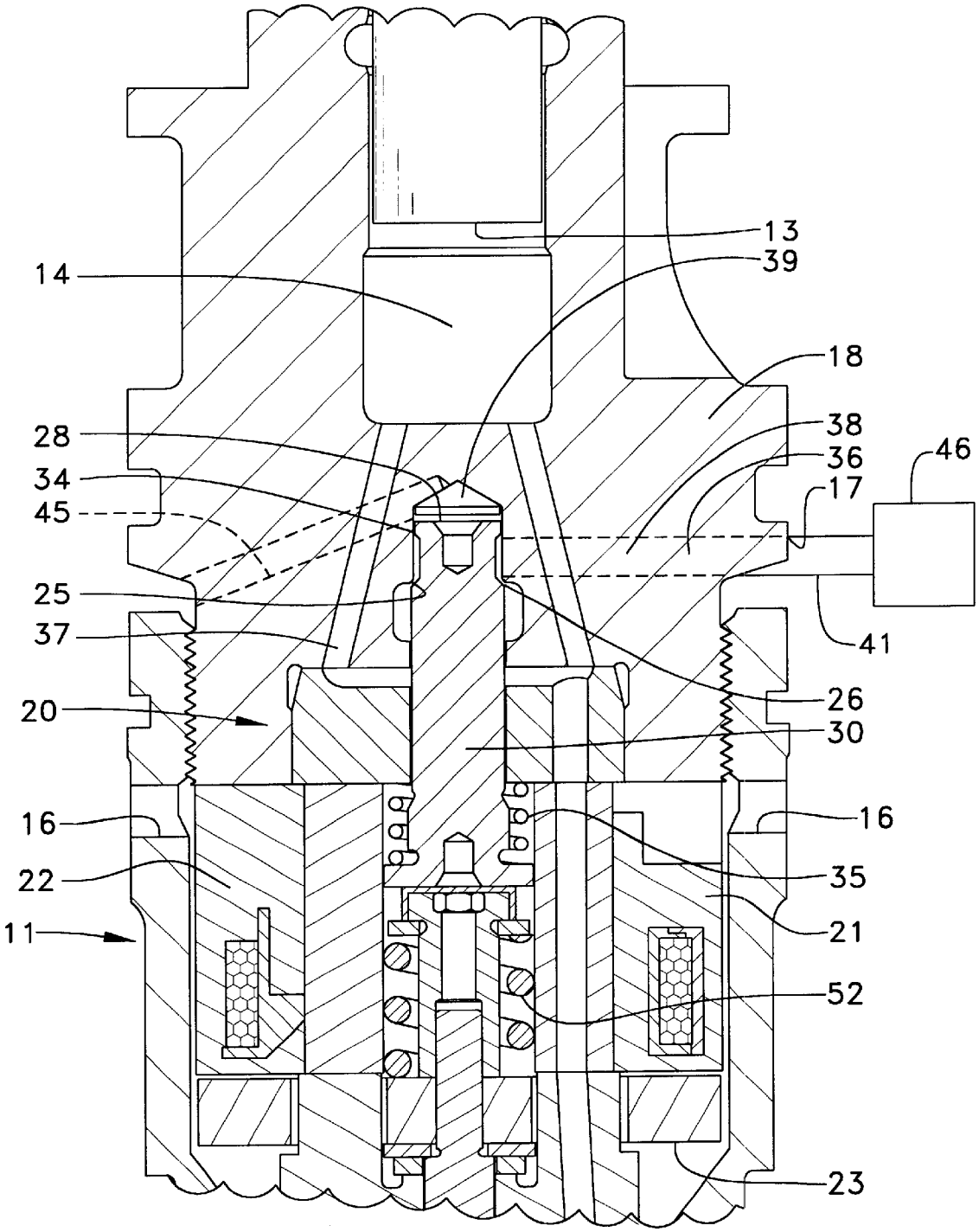
FIG. 2 is a diagrammatic partial sectioned front view of the fuel injector of FIG. 1.

Referring now to FIGS. 1 and 2, a fuel injector 10 includes an injector body 11 which includes a barrel 18 and a plurality of components attached to one another in a manner well known in the art. Barrel 18 defines a plunger bore 12 within which a plunger 13 is driven to reciprocate by some suitable means, such as hydraulic pressure or a cam driven tappet assembly, etc. A portion of plunger bore 12 and plunger 13 define a fuel pressurization chamber 14 that communicates with a nozzle outlet 70 via a nozzle supply passage 60 and a nozzle chamber 61. Fuel pressurization chamber 14 can therefore act to inject liquid distillate diesel fuel into a designated combustion space. Injector body 11 defines a fuel inlet 16 and a low pressure drain 17. Fuel can flow into injector body 11 from a fuel source 48 via a fuel supply line 43, through fuel inlet 16. Low pressure fuel exiting injector body 11 can flow through a low pressure passage 41, via low pressure drain 17, into a low pressure reservoir 46.

When plunger 13 is undergoing its downward pumping stroke, pressure is unable to build in fuel pressurization chamber 14 while a spill valve assembly 30 is open. Spill valve assembly 20, which is contained within injector body 11, includes an electrical actuator 21 which is preferably a three position solenoid 22, as shown in FIGS. 1 and 2, but could be another suitable device such as a piezoelectric actuator. Solenoid 22 includes an armature 23 which is operably connected to a spill valve member 30. While spill valve member 30 has been shown as a poppet valve member, it should be appreciated by those skilled in the art that a different valve member, such as a spool valve member, could be substituted to accomplish similar results. Spill valve assembly 30 also includes a spill passage 36 that is defined by injector body 11. Spill passage 36 is composed of two segments, an upstream segment 37 and a downstream segment 38. A portion of downstream segment 38 is a turbulence chamber 39. Spill valve member 30 includes a hydraulic surface 28 which is exposed to fluid pressure within turbulence chamber 39. Also included on spill valve member 30 is a conical valve surface 26 which can contact a conical valve seat 25 of injector body 11 to close upstream segment 37 from downstream segment 38. Thus, upstream segment 37 is separated from downstream segment 38 by conical valve seat 25. Spill valve member 30 is moveable between a closed position, in which conical valve surface 26 and conical valve seat 25 are in contact, and an open position, in which conical valve surface 26 and conical valve seat 25 are out of contact.

Spill valve member 30 is normally biased away from its closed position by a biasing spring 35, resulting in open fluid communication between upstream segment 37 and downstream segment 38. Therefore, when solenoid 22 is de-energized, the force of biasing spring 35 prevails and fuel pressurization chamber 14 is open to low pressure reservoir 46 via low pressure passage 41, upstream segment 37 and downstream segment 38. Thus, when upstream segment 37 is open to downstream segment 38, the fuel displaced from fuel pressurization chamber 14 is recirculated for later use, and pressure within fuel injector 10 is unable to build to the relatively high injection pressures. Conversely, when solenoid 22 is energized, armature 23 and spill valve member 30 are lifted against the action of biasing spring 35 to close conical valve seat 25 and fuel pressure in fuel pressurization chamber 14, nozzle supply passage 60 and nozzle chamber 61 can rise rapidly. Thus, in order to raise fuel pressure to initiate an injection event, solenoid 22 must be energized to lift spill valve member 30 to close upstream segment 37 from downstream segment 38.

When solenoid 22 is first energized, armature 23 begins to move spill valve member 30 upward against the action of biasing spring 35. As spill valve member 30 moves upward toward the closed position, a small amount of fuel within turbulence chamber 39 can be evacuated via a vent passage 45. Fuel exiting vent passage 45 is channeled into downstream segment 38 and can then flow into low pressure reservoir 46. Vent passage 45 should be large enough to allow a sufficient amount of fuel to be removed from turbulence chamber 39 to allow solenoid 22 to move spill valve member 30 upward against the action of biasing spring 35. The movement of spill valve member 30 is also dependent upon the dimensions of a spill valve clearance 34 located between spill valve member 30 and barrel 18. Spill valve clearance 34 should be tight enough to prevent spill valve member 30 from opening too quickly after solenoid 22 is de-energized. This undesirable effect could result in spill valve member 30 rebounding upward under the action of spring 52 and possibly reclosing. However, spill valve clearance 34 should not be so tight that a sufficient flow of fuel around spill valve member 30 is not possible.

Returning to fuel injector 10, a direct control needle valve member 55 is movably mounted in injector body 11 between a first position, in which nozzle outlet 70 is open, and a downward second position in which nozzle outlet 70 is blocked. A needle biasing spring 65 normally biases needle valve member 55 toward a downward position to close nozzle outlet 70. Needle valve member 55 includes an opening hydraulic surface 57 that is exposed to fluid pressure in nozzle chamber 61. Needle valve member 55 also includes a closing hydraulic surface 54 which is exposed to fluid pressure in a needle control chamber 53 that is alternately connected to a high pressure passage 64 or a low pressure passage 63.

When solenoid 22 is de-energized, or energized to its low current level there is insufficient force for a needle control valve member 50 to overcome the force of biasing spring 52 and move to a closed position. Therefore, when solenoid 22 is in one of these two settings, valve seat 51 remains open and needle control chamber 53 is in fluid communication with fuel pressurization chamber 14 via a high pressure passage 64, past valve seat 51. However, when solenoid 22 is energized to its high current level, needle control valve member 50 can lift to close valve seat 51, thus fluidly connecting needle control chamber 53 to a low pressure area via a low pressure passage 63 and a leakage clearance 62 which exists between the outer surface of needle valve member 55 and an inner bore. Thus, when solenoid 22 is energized to its high current level, closing hydraulic surface 54 is exposed to low fluid pressure, which causes needle valve member 55 to behave as an ordinary spring biased check valve. However, closing hydraulic surface 54 should be preferably sized to hold needle valve member 55 in its closed position, even in the presence of high fuel pressures, when solenoid 22 is de-energized or energized to its lower level.

INDUSTRIAL APPLICABILITY

Prior to the start of an injection event, low pressure in fuel pressurization chamber 14 prevails and plunger 13 is in its retracted position, spill valve member 30 is biased toward its open position by the action of biasing spring 35, upstream segment 37 is fluidly connected to downstream segment 38, needle control valve member 50 is positioned to open valve seat 51, and needle valve member 55 is in its seated position closing nozzle outlet 70. The injection event is initiated by activation of solenoid 22 to its low current level. When solenoid 22 is activated to this low setting, armature 23 lifts spill valve member 30 to compress biasing spring 35. At this current level, biasing spring 52 remains uncompressed beyond its preload, thus maintaining needle control valve member 50 in the open position. As armature 23 lifts spill valve member 30 toward the closed position, an amount of fuel in turbulence chamber 39 is evacuated through vent passage 45 to allow the force of solenoid 22 to overcome the pressure force of the fuel moving through spill valve clearance 34. This evacuated fuel flows into low pressure reservoir 46 for recirculation. Armature 23 lifts spill valve member 30 to close conical valve seat 25, which in turn closes upstream segment 37 from downstream segment 38. Once upstream segment 37 is no longer in fluid communication with downstream segment 38 there is a resulting rapid rise in fuel pressure in fuel pressurization chamber 14, nozzle supply passage 60, high pressure passage 64, and nozzle chamber 61. However, because solenoid 22 remains energized at its lower setting, the building high pressure in high pressure passage 64 acts upon closing hydraulic surface 54 to hold needle valve member 55 in its downward closed position.

When fuel spray into the combustion chamber is to commence, a signal is sent to solenoid 22, which is then energized to its higher setting. Once this occurs, spill valve member 30 remains in its closed position, but needle control valve member 50 moves from its open position to close valve seat 51 to relieve the high pressure in needle control chamber 53. Relatively high fuel pressure in nozzle chamber 61 then lifts needle valve member 55 upward to its open position to commence the spraying of fuel out of nozzle outlet 70. Shortly before the desired amount of fuel has been injected, a signal is sent to solenoid 22 to end the injection event. Solenoid 22 is de-energized and spill valve member 30 returns downward to the open position under the action of biasing spring 35 and the hydraulic assist force acting on surface 28, and needle control valve member 50 returns to its downward position to open valve seat 51.

Between injection events various components of injector body 11 begin to reset themselves in preparation for the next injection event. Because the pressure acting on plunger 13 has dropped, a return spring moves plunger 13 back to its retracted position. The retracting movement of plunger 13 causes fuel from fuel inlet 16 to be pulled into fuel pressurization chamber 14 through fuel supply line 43.

The present invention exploits the hydraulic pressure within turbulence chamber 39 to aid the downward movement of spill valve member 30 to open spill passage 36. When solenoid 22 is first de-energized and upstream segment 37 is still closed to downstream segment 38, spill valve member 30 is hydraulically balanced, having low pressure both above and below it. In this condition, the spring force of biasing spring 35 is sufficient to move spill valve member 30 away from its closed position, seated at conical valve seat 25. High pressure fuel traveling from fuel pressurization chamber 14 through upstream segment 37 possesses a certain amount of dynamic pressure. Turbulence chamber 39 should be shaped and positioned such that an amount of this dynamic pressure is converted into stagnation pressure. The stagnation pressure of the fuel within turbulence chamber 39 can then aid in moving spill valve member 30 away from the closed position, thus creating a relatively quick relief of pressure to low pressure drain 17. In this manner, the present invention can help to relieve pressure on spill valve member 30 which will reduce the amount of engine energy consumed unnecessarily pressurizing fuel after an injection event by exploiting the hydraulic forces within the fuel injector to provide quick spill of residual pressure.

It should be understood that the above description is intended only to illustrate the concepts of the present invention, and is not intended to in any way limit the potential scope of the present invention. For instance, while the spill valve member has been shown as a poppet valve, a spool valve member could also be used. Further, while the present invention utilizes a biasing spring to bias the spill valve member toward the open position and an electrical actuator to move the spill valve member toward the closed position, it should be appreciated that the functions of these two components could be reversed. Additionally, while the spill valve member in the present invention is hydraulically balanced, the invention could still perform if the spill valve were not hydraulically balanced. Thus, various modifications could be made without departing from the intended spirit and scope of the invention as defined by the claims below.

What is claimed is:

1. A hydraulic valve with hydraulically assisted opening comprising:

a valve body defining a fluid passage, said fluid passage having an upstream segment and a downstream segment;

a moveable valve member at least partially positioned within said valve body, an end of said valve member including a hydraulic surface that defines a portion of said downstream segment;

said upstream segment of said fluid passage being closed to said downstream segment when said valve member is in a closed position;

said upstream segment of said fluid passage being fluidly connected to said downstream segment when said valve member is away from said closed position;

an electrical actuator attached to said valve body and being operable in an energized state to move said valve member toward said closed position;

a spring operably positioned to bias said valve member toward a fully open position;

said upstream segment of said fluid passage is fluidly connected to a source of high pressure fluid;

said downstream segment of said fluid passage is fluidly connected to a low pressure reservoir;

a portion of said downstream segment is a turbulence chamber;

said hydraulic surface is exposed to fluid pressure in said turbulence chamber; and an amount of fuel flowing from said upstream segment to said downstream segment having a dynamic pressure, said turbulence chamber being shaped and positioned to convert a portion of said dynamic pressure into a stagnation pressure.

2. The hydraulic valve of claim 1 wherein said valve member is a poppet valve member;

said upstream segment is separated from said downstream segment by a conical valve seat; and said upstream segment is closed to said downstream segment when said poppet valve member is seated in said conical valve seat.

3. A fuel injector comprising:

an injector body defining a spill passage, said spill passage having an upstream segment and a downstream segment;

a moveable valve member at least partially positioned within said injector body, an end of said valve member including a hydraulic surface that defines a portion of said downstream segment;

said upstream segment of said spill passage being closed to said downstream segment when said valve member is in a closed position;

said upstream segment of said spill passage being fluidly connected to said downstream segment when said valve member is away from said closed position;

an electrical actuator attached to said injector body and being operable in an energized state to move said valve member toward said closed position;

a spring operably positioned to bias said valve member toward a fully open position;

said upstream segment of said spill passage is fluidly connected to a source of high pressure fuel;

said downstream segment of said spill passage is fluidly connected to a low pressure reservoir;

a portion of said downstream segment is a turbulence chamber;

said hydraulic surface is exposed to fluid pressure in said turbulence chamber; and an amount of fluid flowing from said upstream segment to said downstream segment having a dynamic pressure, said turbulence chamber being shaped and positioned to convert a portion of said dynamic pressure into a stagnation pressure.

4. The fuel injector of claim 3 wherein said valve member is a poppet valve member;

said upstream segment is separated from said downstream segment by a conical valve seat; and said upstream segment is closed to said downstream segment when said poppet valve member is seated in said conical valve seat.

5. The fuel injector of claim 4 wherein said amount of fluid is an amount of fuel.

6. The fuel injector of claim 5 including a direct control needle valve.

7. A method of operating a spill valve, comprising the steps of:

opening an upstream segment of a fluid passage to a downstream segment of said fluid passage, at least in part by moving a valve member from a closed position toward a fully open position;

assisting movement of said valve member to said fully open position, at least in part by exposing an opening hydraulic surface of said valve member to fluid pressure in a turbulence chamber that is a portion of said downstream segment;

said assisting step includes a step of converting dynamic pressure of fluid in said downstream segment to stagnation pressure in said turbulence chamber;

said opening step includes the steps of mechanically biasing said valve member away from said closed position, and de-energizing an electrical actuator operably coupled to said valve member; and closing said upstream segment to said downstream segment, at least in part by energizing said electrical actuator.

8. The method of claim 7 including a step of connecting said upstream segment to a source of high pressure fluid and connecting said downstream segment to a low pressure reservoir.

* * * * *